United States Patent [19]

Hula et al.

[11] Patent Number: 5,009,750

[45] Date of Patent: Apr. 23, 1991

[54] PROCESS AND APPARATUS FOR THE MANUFACTURE OF A METAL FOIL

[75] Inventors: Emil Hula, Giesshübl; Gerald Maresch, Mödling, both of Austria

[73] Assignee: Maschinenfabrik Andritz Actiengesellschaft, Graz-Andritz, Austria

[21] Appl. No.: 436,638

[22] Filed: Nov. 15, 1989

[30] Foreign Application Priority Data

Nov. 15, 1988 [AT] Austria ..... 2801/88
Sep. 28, 1989 [AT] Austria ..... 2263/89

[51] Int. Cl.[5] ..... C25D 1/04
[52] U.S. Cl. ..... 204/13
[58] Field of Search ..... 204/13

[56] References Cited

U.S. PATENT DOCUMENTS

| | | | |
|---|---|---|---|
| 2,433,441 | 12/1947 | Davidoff | 204/13 |
| 3,799,847 | 3/1974 | Vladimirovna | 204/13 |
| 4,053,370 | 10/1977 | Yamashita | 204/13 |
| 4,108,737 | 8/1978 | Ehrhardt et al. | 204/13 |
| 4,469,565 | 9/1984 | Hampel | 204/15 |
| 4,568,431 | 2/1986 | Polan et al. | 204/13 |

FOREIGN PATENT DOCUMENTS

| | | |
|---|---|---|
| 48-32063 | 10/1973 | Japan . |
| 49-98338 | 9/1974 | Japan . |

*Primary Examiner*—T. M. Tufariello
*Attorney, Agent, or Firm*—Fleit, Jacobson, Cohn, Price, Holman & Stern

[57] ABSTRACT

In a process for the manufacture of a metal foil, the metal foil is deposited electrolytically on an endless carrier belt, preferably an endless metal belt, in one or more cells, the current density being set to different levels in the plurality of cells and/or within each individual cell. A post treatment of the metal foil manufactured takes place wholly or at least in part on the endless carrier belt, thereby metal foils, respectively metal composite foils can be manufactured at favorable cost and with low labor input. The apparatus for carrying out the process comprises a plurality, at least two, vertical deposition cells having two upper deflecting rolls 21, 21' and at least one lower deflecting roll 22, the endless carrier belt 1, the anode 23, optionally composed of a plurality of partial anodes, and lateral sealing strips 24, forming a closed shaft through which the electrolyte flows, a plurality of, at least three, current rolls 30, 30', 22 being associated with each cell 2 and the arc of contact being at least 2°.

9 Claims, 2 Drawing Sheets

PROCESS AND APPARATUS FOR THE MANUFACTURE OF A METAL FOIL

BACKGROUND OF THE INVENTION AND PRIOR ART

The present invention relates to a process and an apparatus for the manufacture of a metal foil wherein the metal foil is deposited electrolytically on an endless carrier belt, preferably on an endless metal belt.

In known processes for the manufacture of metal foils such foils, in particular copper foils, are deposited electrolytically on drums. These drums are connected as cathode and dip by about 40% of their circumference into an aqueous metal salt solution. The anodes are arranged at a distance of about 10 mm from the drum periphery. The metal is deposited on the drum by electric current. The rate of rotation of the drum and the current setting dictate the desired foil thickness, about 20,000 to 25,000 ampere per drum being conventionally used.

The metal foil so produced is drawn off the drum, wound up and subsequently subjected to further treatment in a separate plant.

In such subsequent treatment the individual metal foils are connected to form an endless belt, are conveyed through a plurality of galvanic cells and the desired metal or alloy coatings are applied.

The above process has by now received world-wide acceptance although it suffers from numerous drawbacks. For example the foil texture cannot be influenced by different current densities because only a given current density can be applied to a given drum. Moreover the subsequent treatment must be conducted in a separate plant, necessitating cumbersome and time-consuming operations. Finally, an important drawback of the above described process resides in the fact that in particular thin metal foils having thicknesses below 10 $\mu$m cannot be produced, because such foils cannot be wound.

A process has become known from U.S. Pat. No. 4,108,737 (Ehrhardt et al.) for the manufacture of superconductive foils, strips or wires by electrolytic deposition on an endless steel belt. However, the deposition in principle proceeds in the same manner as was described above. The carrier belt is accommodated in the one and only deposition cell being wound about a single drum which dips into the liquid as is apparent particularly from the drawing of that U.S. Pat. No. 4,108,737.

Only one particular strength of current can be applied to this drum, and the carrier belt merely serves the purpose of facilitating the passage of the foil through passivating and cleaning baths by means of the carrier belt. Such cleaning treatment would be possible on the drum itself at great expenditure only. This process as well is subject, in respect of the deposition, to the same drawbacks as the previously recited method.

OBJECTS AND BRIEF GENERAL DESCRIPTION OF THE INVENTION

It is thus an object of the present invention to provide a process of the type stated in the introduction which overcomes the aforementioned drawbacks and permits the manufacture of metal foils at reasonable cost.

This object is attained according to the invention with a process of the type defined in the introduction in that the metal foil is deposited in one or more cells, the current density being set to different levels along the travelling path of the belt through the cell or cells.

According to a further preferred feature of the invention the current density is also set to varying levels along the path of the carrier belt within an individual cell as such, e.g. each individual cell.

Thus it is possible, in addition to influencing the texture of the foil due to the setting up of different current densities in the preferably plurality of cells of the deposition plant, to furthermore vary the deposition characteristics even within each individual cell. This feature is of particular importance in applications wherein in the individual cells different metals or metal alloys are deposited or different electrolytes are used. In the case of a plant having only a single deposition cell this procedure is even essential in order to be able to influence the foil texture.

In the apparatus for carrying out the process, the endless metal belt passes through one or more vertical cells, each comprising two upper deflecting rolls and at least one lower deflecting roll, in which on one side of the endless belt the foil is caused to grow. The individual cells are so designed that a closed shaft through which the electrolyte flows, is formed by the endless carrier belt, the anodes and by laterally provided sealing strips.

It will be understood that precise verticality of the cells is not essential to the functioning thereof.

According to the invention the deposition cells comprise a plurality of at least three current rolls in the ambit of at least one cell, the arc of belt contact being at least 2°, and the anode extends along the path of the carrier belt.

According to important preferred features of the process according to the invention, the electrolyte flows through the cells, and the flow velocity is in the range of 0,1 to 6,0 m/sec, preferably 1 to 4 m/sec. This flow velocity can in this context be adjusted at will within this range of magnitude by the provision of a drainage means of variable cross-section in what is substantially the lowest region of the anode.

The anode may for example be made of lead, a lead alloy or titanium with a noble metal coating. Alternatively soluble anodes may be used.

According to a further feature of the invention, the current rolls are connected individually or in optional combinations to the anode by way of rectifiers.

Further features of the invention will be explained and elaborated on in the following with reference to the accompanying drawings.

DESCRIPTION OF SPECIFIC EMBODIMENTS OF THE INVENTION

Figure 1:
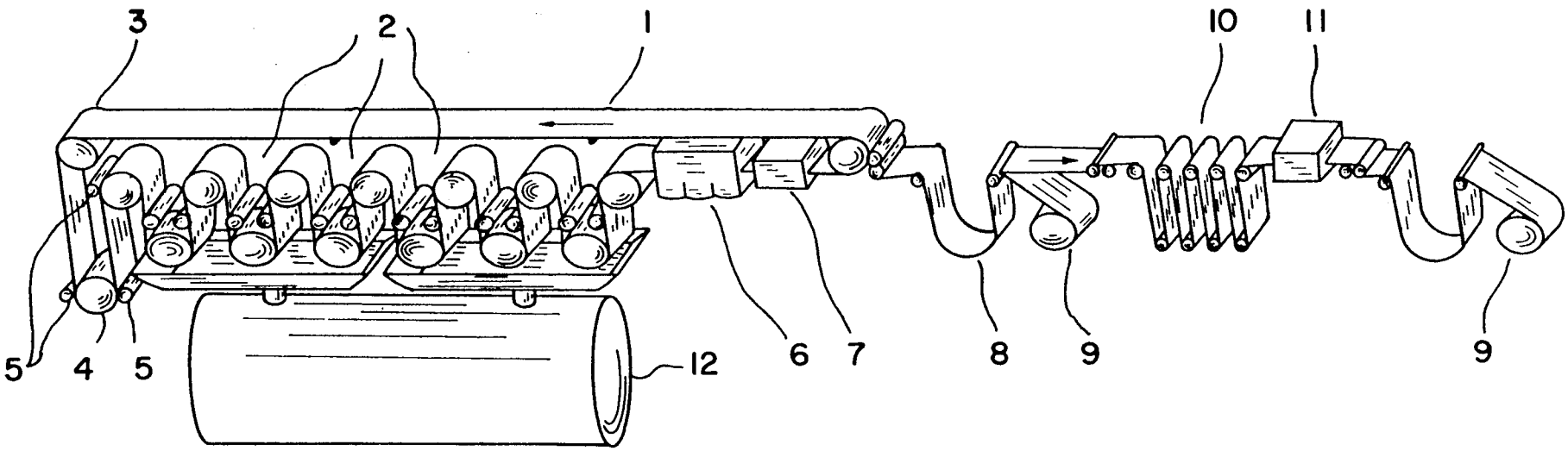
FIG. 1 in a diagrammatic representation shows a plant for the electrolytic manufacture of metal foils according to the invention, and FIG. 2 a section through a deposition cell to be used therein according to a preferred working example.

As illustrated in FIG. 1, an endless carrier belt passes through preferably a plurality of vertical cells 2 which in the example illustrated are combined in two groups of three cells each. A centering control 3 takes care of the accurately aligned passage of the belt 1. Prior to entry into the cells 2, the belt 1 is passed by way of a vertically movable compensating roll 4 in contact with brushes 5. After having passed through the cells 2, the belt 1 which is now coated with the metal foil, is passed through at least one rinsing plant 6 and a drying plant 7. Thereafter the metal foil 8 is withdrawn from the endless belt 1, is preferably edge trimmed and is wound on the winding means 9. Prior to the winding it is possible however, to include in addition e.g. an electrolytic or purely chemical post treatment in a post treatment plant 10 followed by a dryer 11. According to a modification of the process according to the invention, the post treatment of the metal foil may also take place, at least partly, on the carrier belt 1 prior to the withdrawal of the foil, such that only the post treatment on that side which faces the endless belt needs to take place after the separation of the foil.

Item 12 denotes a circulating vessel for the electrolyte of the cells 2. It stands to reason that a plurality of vessels 12 may also be provided, which in any event will be essential if different electrolyte liquids are used in the individual cells 2 or cell groups. From this vessel 12, the electrolyte, where applicable after recovery respectively purification, is recirculated to the depositing cells 2 by way of circulating pumps (not illustrated). The endless carrier belt 1 is cleaned mechanically, chemically or electro-chemically in a conventional plant (not illustrated) after each completed passage.

The design of a cell for the electrolytical manufacture of metal foil according to the invention will be further explained with reference to FIG. 2.

The endless carrier belt 1 passes by way of a first upper deflecting roll 21 to a lower deflecting roll 22. From this lower deflecting roll 22, the belt 1 is passed again upwardly to a second, upper deflecting roll 21'. If a plurality of cells is set up in succession, the upper deflecting rolls 21, 21' can in each case be shared by two adjoining cells 2. Between the upper deflecting rolls 21, 21' and the lower deflecting roll 22 the belt 1 is conducted along a direction which differs from vertical but which preferably is approximately vertical. The anode 23 which according to the invention may also comprise a plurality of partial anodes is so arranged in relation to the belt 1 in the cell 2, that the gap between the anode 23 and the belt 1 is filled completely by electrolyte flowing therethrough. The anode follows the path of the carrier belt 1 and forms on that side of the belt 1 which is opposite to the lower deflecting roll 22, in collaboration with the belt itself and, where applicable, sealing strips 24 between the former and the anode 23, a passage through which the electrolyte flows. This passage is terminated substantially at its lowest point by a drainage aperture 25 of adjustable cross-section. The latter may for example take the form of a pipe-nipple with a throttle gate and permits the adjustment of the flow velocity of the electrolyte liquid. The latter is introduced in the upper region of the anode 23 by way of a flow becalming vessel 26, 26' and the overflow 27, 27' into the passage between the belt 1 and the anode 23 whilst any excess liquid introduced enters into an overflow vessel 28, 28' and from there passes directly to the circulating vessel 12.

The electrolyte flowing through the cell 2 similarly passes from the drainage means 25 into the vessel 12.

According to the essential feature of the apparatus according to the invention, each cell 2 comprises a plurality of current rolls. For that purpose the vertical sections of the cell 2, preferably on mutually opposite sides, are provided with at least two current rolls 30, 30' opposite to the anode 23. The lower deflecting roll 22 also performs the function of a further current roll.

Figure 2:
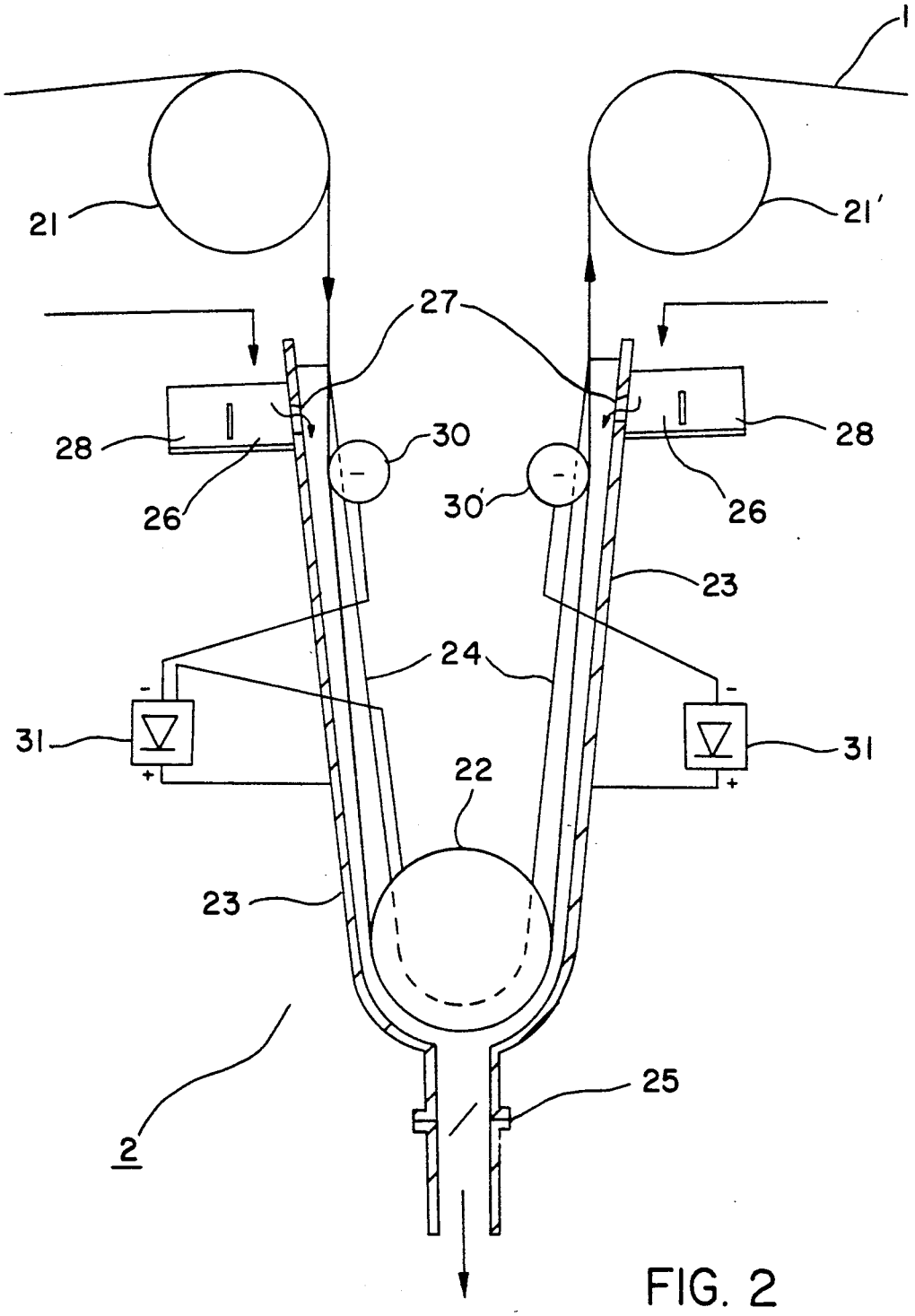

The preferably employed modification as illustrated in FIG. 2 provides for exactly three current rolls per cell 2. Two rolls 30, 30' are provided in the upper region of the electrolyte passage and the third current roll acts as the lower deflecting roll 22 at the same time. The current rolls 30, 30' and 22 as well as any further current rolls which may be present, may be connected to the anode 23 either individually or combined in optional groups, at least one rectifier 31 being also included in each connection.

The deposition of the metal foil on the endless carrier belt 1 at different current density levels along the belt 1 in the region of the cell 2, or more accurately along the anode 23, is possible due to the application of different current strengths to the current rolls, respectively current roll groups. Thus the deposition at low current densities results in a homogeneous distribution of the particles whereas a high current density brings about a change in the grain size. The mechanical properties of the deposited metal foil may also for example be varied as a function of the aforementioned texture variations.

In accordance with the invention it is further provided that in a multiple cell plant different electrolytes may be used in different cells, so that different metals or metal alloys can be deposited in different cells. In that case the carrier belt 1 and the foil contained thereon is subjected to rinsing with water prior to its entry into the next cell containing a different electrolyte.

The process according to the invention may also be employed advantageously for the manufacture of composite materials, in particular of composite metal foils wherefore one or a plurality of plants for manufacturing foils are so combined with feed roll means for synthetic resin strips that a composite material foil-plastics is formed.

In the following additional details and advantages of the process according to the invention will be further explained by way of working examples:

In a foil plant designed for carrying out the process according to the invention, comprising two cells, a carrier belt of titanium, 1200 mm wide and anodes of 1000 mm width, a copper foil 17,5 μm thick was produced on an acid copper sulphate electrolyte with various additives. The applied current density was 80 $A/dm^2$, the electrolyte flow velocity 3,45 m/sec. The foil after having been manufactured, was rinsed while still on the carrier belt, dried and could thereafter be easily lifted off.

In a further experiment, the copper foil after drying and still prior to being lifted off was contacted with a plastics belt coated on one side with an adhesive, pressed together therewith and lifted off the carrier belt only thereafter.

By increasing the travelling velocity of the carrier belt 3 to 5 fold as compared with the first example, a copper foil of 5 μm thickness was produced in a subsequent process which similarly could easily be lifted off the carrier.

In the same plant the titanium carrier belt was replaced by a niobium stabilized highly refined steel belt, and a zinc foil of 20 μm thickness was manufactured using a zinc sulphate electrolyte in a plurality of cells arranged in series and was coated with a 5 μm thick zinc-nickle-coating in a subsequent cell after having been rinsed. In that test the current density for manufacturing the zinc coating was 120 $A/dm^2$ and the current density for the manufacture of the zinc-nickle-coating 65 $A/dm^2$.

Thereafter the test plant was extended by two further cells and a new carrier belt was inserted made of copper, plated on all sides with titanium. In the two cells in the middle, titanium baskets filled with sintered iron pellets were introduced in place of the insoluble anodes, whereas in the first and the fourth cell the insoluble anodes were retained. The first and fourth cell were each operated with a zinc electrolyte and the second and third cell with an iron electrolyte, and in this manner an iron foil, zinc coated on both sides was produced.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

We claim:

1. A process for the manufacture of a metal foil by deposition of an electrolyte on an endless carrier belt, said process including the steps of: providing at least one vertically extending wall defining a vertically extending anode element, providing the belt with an upper deflecting roll adjacent an upper portion of said wall and a lower deflecting roll adjacent a lower portion of said wall, said rolls being positioned to provide a vertically extending run of the belt adjacent the anode element, said run of the belt and the anode element defining therebetween a vertically extending passage for electrolyte, providing lateral sealing elements to enclose said passage, providing a flow becalming vessel for electrolyte adjacent an upper end of said wall, said vessel having an overflow leading into an upper end of said passage, providing an adjustable cross-section drainage aperture at a lower end of said wall for draining electrolyte from said passage, supplying electrolyte to said passage from said vessel, adjusting the cross-sectional area of said drainage aperture to control the electrolyte flow through said passage, causing the belt to traverse said run, and providing electric current flow between the anode element and said run of the belt at a varying current density along the length of said run to deposit metal on the belt and form a foil.

2. A process as defined in claim 1 wherein said wall comprises one vertically extending wall of a cell which also includes an opposite vertically extending wall defining a further anode element, wherein the belt is provided with a further upper deflecting roll adjacent an upper end of said opposite wall, said further roll being positioned to provide the belt with a further vertically extending run adjacent the further anode element, said further run and said further anode element defining therebetween a further vertically extending passage for electrolyte, wherein further lateral sealing elements are provided for the further passage, wherein a further flow becalming vessel for electrolyte is provided adjacent the upper end of the further passage with an overflow into the further passage, wherein said further passage has a lower end communicating with said drainage aperture, wherein electrolyte is supplied to said further passage from said further vessel, wherein the belt is caused to move downwardly from one of said upper roll to said lower roll and upwardly from said lower roll to the other of said upper rolls and wherein electric current is caused to flow between the further anode element and said further run of the belt at a varying current density along the length of said further run.

3. A process according to claim 1 wherein said lower roll forms part of an electric circuit for supplying said current.

4. A process according to claim 1 wherein the cross-sectional area of said drainage aperture is adjusted to provide a flow velocity of electrolyte through said passage in a range of 0.1 to 6.0 m/s.

5. A process according to claim 4 wherein the flow velocity is in a range 1.0 to 4.0 m/s.

6. A process according to claim 1 which includes the step of post-treating the foil after exit of the belt from said passage and prior removing the foil from the belt.

7. A process according to claim 1 which includes the step of cleaning the belt after removal of the foil.

8. A process according to claim 2 wherein the process is replicated in a plurality of successive cells with different electrolytes in the respective cells.

9. A process according to claim 8 wherein the respective cells are operated with currents of different current densities.

* * * * *